US005209960A

United States Patent [19]

Ping

[11] Patent Number: 5,209,960

[45] Date of Patent: May 11, 1993

[54] ANTI-QUAKE FURNITURE

[76] Inventor: Jan F. Ping, 19 Alley 24 Lane 284 Wu-Hsing street, Taipei, Taiwan

[21] Appl. No.: 713,307

[22] Filed: Jun. 11, 1991

[51] Int. Cl.[5] ..... B32B 1/04; B32B 7/06

[52] U.S. Cl. ..... 428/119; 428/61; 211/189

[58] Field of Search ..... 428/99, 119, 120; 119/17; 52/167 R; 211/189

*Primary Examiner*—Alexander S. Thomas

*Attorney, Agent, or Firm*—Yuso International Patent and Trademark Office

[57] ABSTRACT

An anti-quake furniture comprising a top lid, a plurality of mid-pole structures a base frame and a plurality of fastening members; the top lid, the mid-poles and the base frame are assembled together by means of a plurality of connecting ends and connecting sleeves self-contained on the aforesaid major members to form a cubic structure. The various mid-pole structures are assembled together with the fastening members so as to have the top lid, the mid-pole structures, and the base frame assembled into a strong furniture to be used as a haven in case of earthquake.

1 Claim, 4 Drawing Sheets

ANTI-QUAKE FURNITURE

BACKGROUND OF THE INVENTION

Various intensity earthquakes often take place at various areas in the world; unfortunately, the earthquake cannot with present technology be anticipated as we often can do in the case of a typhoon. As a result, human beings can do nothing about earthquakes. There is one thing we can do, i.e., a person in a house can take cover under an item of furniture in case of an earthquake; such a way of taking cover has been announced often through television or other media. Unfortunately, it is difficult to be able to take cover under conventional furniture; according to our experience, only small (non adult) children can take cover under a piece of furniture,; further, almost none of the furnitures is designed particularly for earthquake considerations; therefore, conventional furniture might not be good enough for a small child to take cover therein. It is a problem that the furniture dealer has difficulty to manufacture antiquake furniture. Strong funiture must be made of metal; most of the conventional furnitures are assembled together by means of welding or casting to provide the desired strength; however, such a strong furniture usually is incapable of being moved into a room as a result of its large dimensions. High strength furniture may be disassembled while being being moved into a room; in which case, the furniture may be assembled in the room by welding methods, but it is questionable that such a procedure would be accepted by the owner or buyer. Of course, funiture may be assembled together with screws, or rivets or other conventional methods, but the strength thereof will be reduced considerably.

SUMMARY OF THE INVENTION

This invention relates to an anti-quake-furniture, and particularly to a furniture, such as a bed or cabinet, to be assembled together by means of a series of insertion and sleeve members being arranged longitudinally or laterally. The present invention comprises a top lid, a plurality of Mid pole structures, a base frame and a plurality of fastening members. The four edges of the top lid are provided with a plurality of vertical poles with pointed connecting ends and connecting sleeves and depending from the top lid; the four edges of the base frame also have a plurality of connecting ends with connecting sleeves and slot holes respectively; the connecting sleeves are to be mated with the lower connecting ends and sleeves respectively; the furniture is substantially a cubic structure. All the mid-pole structures are assembled together by means of one or two fastening members so as to have the top lid, the mid-pole structures, and the base frame assembled together firmly as one piece.

The prime feature of the present invention is to provide an anti-quake furniture to be set in house as a normal furniture (such as a bed or cabinet), and the furniture can also be used as a haven in case of earthquake.

Another feature of the present invention is to provide an anti-quake furniture, which is assembled together by means of a series of longitudinal and lateral insertion and sleeve members; all the main elements of the furniture can be moved freely through a door of 50 C.M. width. Furniture of the present invention is to be assembled easily without welding or using other conventional methods.

DETAILED DESCRIPTION

Figure 1:
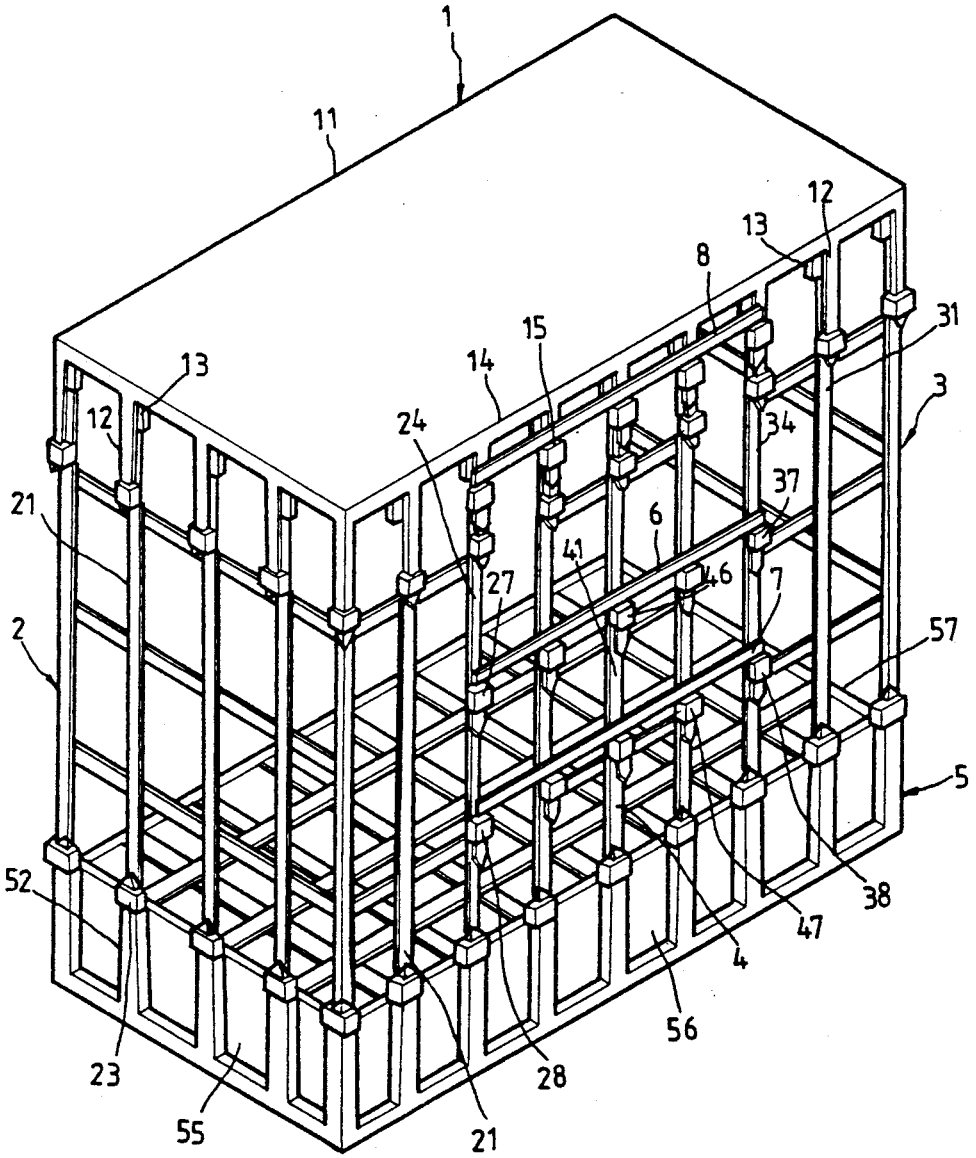
FIG. 1 is a perspective view of an embodiment according to the present invention.
Figure 2:
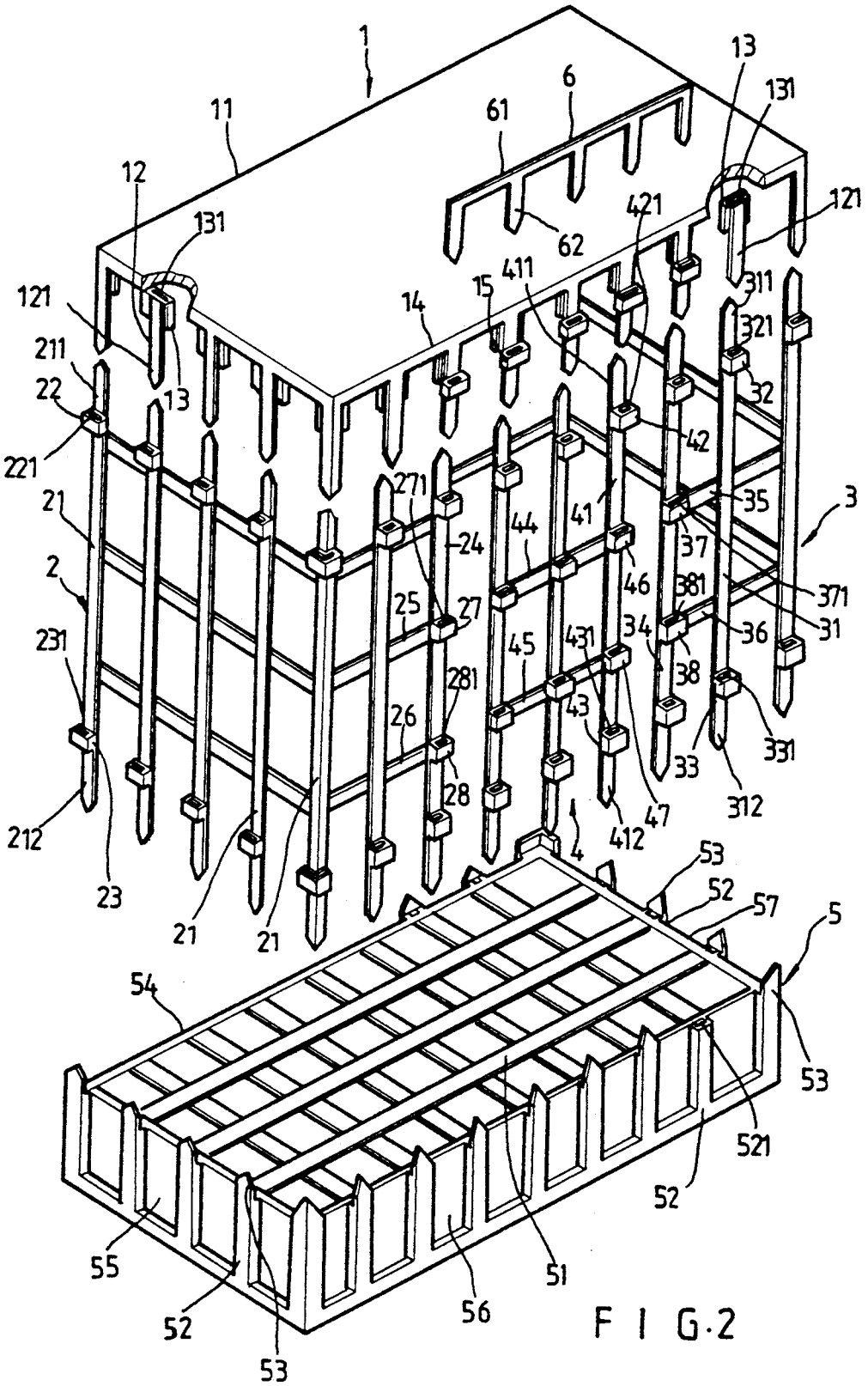
FIG. 2 is a disassembled view of the present invention.
Figures 3, 5:
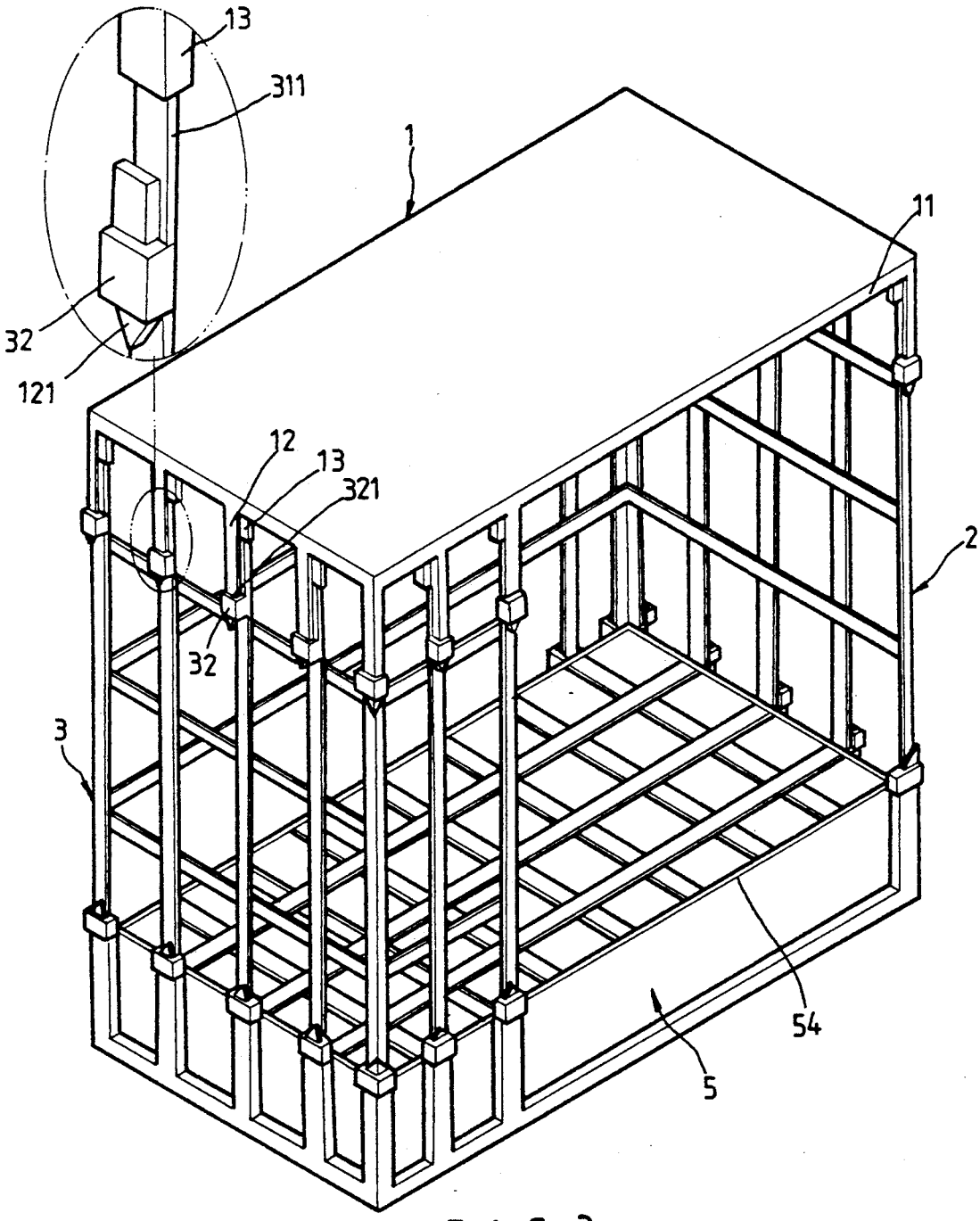
FIG. 3 is another perspective view of the present invention.
FIG. 5 is a perspective view of a connecting end being assembled together with a corresponding connecting sleeve according to the present invention.

Referring to FIGS. 1 and 2, the present invention comprises a top lid 1, three types of fence structures 2,3, and 4, a base frame 5, and three fastening members 6,7 and 8. The top lid 1 is a rectangular member with a plurality of vertical poles 12 on four edges thereof, each vertical pole having a pointed connecting end 121. The inner side of each connecting end 121 has a tubular connector 13 with a slot hole 131. All the vertical poles 12 are arranged regularly so as to depend from the four sides of the top lid 1, except that a part of edge 11 does not have vertical poles (as shown in FIG. 3). The outer sides of selected vertical poles 12 on another edge 14 of lid 1 have tubular connectors 15. The fence structure 2 is comprised of vertical poles 21 arranged in a L-shaped fence configuration. Both ends of the vertical poles 21 are formed into pointed connecting ends 211 and 212 respectively. The outer side of the upper connecting end 211 of each pole 21 has a connecting sleeve 22 with a slot hole 221; the outer side of the lower connecting end has a connecting sleeve 23 with a slot hole 231. The zone of a terminal vertical pole 24 is connected with two connecting sleeves 27 and 28 which are on the connecting points of two lateral rods 25 and 26 respectively. The two connecting sleeves 27 and 28 have two slot holes 271 and 281 repectively. The poles in fence structure 3 are arranged regularly in a J-shaped fence configuration, in which each of the vertical poles 31 has two pointed connecting ends 311 and 312; the outer side of the upper connecting end 311 has a connecting sleeve 32 with a slot hole 321, while the outer side of the lower connecting end 312 has a connecting sleeve 33 with a slot hole 331. The outer side of a terminal vertical pole 34 is connected with two connecting sleeves 37 and 38 on the connecting points with the lateral rods 35 and 36 respectively. Both connecting sleeves 37 and 38 have slot holes 371 and 381 respectively. The poles in fence structure 4 are arranged in a straight-line-shaped fence configuration, of which each vertical pole 41 has two pointed connecting ends 411 and 412; the outer side of the upper connecting end 411 has a connecting sleeve 42 with slot hole 421, whole the outer side of the lower ennecting end 412 has a connecting sleeve 43 with a slat hole 431. The connecting points with the lateral rods 44 and 45 are mounted with connecting sleeves 46 and 47 respectively. The base frame 5 is a rectangular member, of which the four sides and the bottom are all flat members; the upper part of the base frame is a grid-shaped supporting rack 51. The four sides of the base frame 5 are furnished with a plurality of tubular connectors 52 with slot holes 521; each of the tubular connectors 52 has a pointed connecting end or prong 53 on the outer side thereof. One side 54 of the base frame that is corresponding to the edge 11 of the top lid 11 has a portion without tubular connectors 52 and connecting ends 53. The fastening members 6, 7 and 8 look like rakes. The lateral rod 61 has a plurality of connecting ends 62 arranged perpendicularly to the rod 61.

Figure 4:
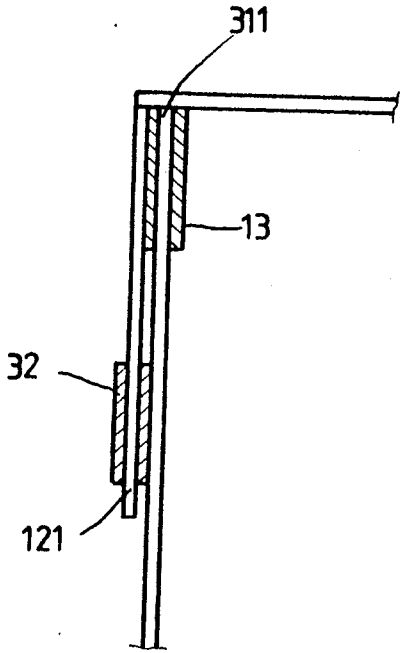
FIG. 4 is a sectional view of a connecting end being assembled together with a corresponding connecting sleeve according to the present invention.

As shown in FIGS. 2 and 3, the furniture item of the present invention can be assembled together by having the lower connecting ends 212 and the tubular sleeves 23 connected with the connecting connectors 52 and the connecting ends 53 on the short side 55 and the long side 56 of the base frame 5 so as to have the fence structure 2 fixed on the base frame 5; the connecting method is shown in FIGS. 4 and 5. Each connecting sleeve 32 and the connecting end 311 are joined into one piece by having the connecting end 311 inserted into the associated tubular connector 13, while the tubular connector 13 and the connecting end 121 are joined into one piece by having the connecting end 121 inserted into the connecting sleeve 32. In the case of fence structure 3, the lower connecting ends 312 with connectin sleeves 33 are joined together with the corresponding tubular connectors 52 and connecting ends 53 on the long sides 54 and 56, the short side 57 of the base frame so as to fix the fence structure 3 on the base frame 5. In the case of fence structure 4, the lower connecting ends 412 with connecting sleeves 43 of the vertical poles 41 are joined together with the corresponding tubular connectors 52 and the connecting ends 53 on the long side 56 of the base frame 5 so as to fix the fence structure on the base frame 5; likewise, the connecting ends 121 with tubular connectors 13 of the vertical poles 12 of the top lid 1 are joined together with the upper connecting sleeves 22,32, and 42, and the connecting ends 211. 311 and 411 of the fence structures 2, 3 and 4 respectively so as to fix the top lid 1, the fence structures 2, 3 and 4, and the base frame together into a cubic structure. The connecting ends 62 of the fastening members 6 are to be joined together with the connecting sleeves 27, 46 and 37 on the vertical poles 24, 41 and 34 of the fence structures 2, 3 and 4 respectively. The fastening member 7 is to be joined with the connecting sleeves 28, 47 and 38, and the fastening member 8 is also mounted in the tubular connectors 15 of the top lid 1, so as to join the three fence structures with the top lid 1. Fence structures 2,3 and 4 are connected to the base frame 5 by means of the fastening member 7; the fence structures 2, 3 and 4 are thus formed into a fence system around the four sides of the base frame 5 except the edge 11 having an opening (as shown in FIG. 3) to be used as an entrance for person. The present invention is substantially a strong furniture structure; the beautiful decoration of the furniture may be varied in accordance with individual's favor. Since the present invention is assembled by means of connecting ends and sleeves without using any welding process and other conventional methods, its strong structure is still much stronger than the welding process. In fact, the welding process is merely a point or a plane connection, but the sleeve-connecting method as used in the present invention is a large and cubic space connection; therefore, a furniture according to the present invention is deemed the best haven in case of earthquake.

I claim:

1. An anti-quake piece of furniture comprising:

a rectangular top lid having four edges, a first plurality of vertical poles extending downwardly from the lid edges at spaced points therealong; each pole having a lower end located below the lid plane; first tubular connectors (13) carried on said first vertical poles in near proximity to said lid;

a rectangular base frame (5) having four edges; second tubular connectors (52) extending upwardly from the base frame edges at spaced points therealong; each said second tubular connector having one wall thereof extending upwardly beyond the end of the connector to form a prong;

a plurality of fence structures extending between said lid and said base frame; each fence structure comprising a second plurality of vertical poles, and a plurality of horizontal rods extending transversely across said last mentioned poles;

each vertical pole in a given fence structure having a lower end and an upper end; an upper connector sleeve mounted on each pole of a given fence structure near the pole upper end; a lower connector sleeve mounted on each pole of a given fence structure near the pole lower end;

said fence structures being rigidly attached to said lid so that the lower ends of said first poles extend downwardly into said upper sleeves, and the upper ends of said second poles extend upwardly into said first tubular connectors;

said fence structures being rigidly attached to said base frame so that the lower ends of said second poles extend downwardly into said second tubular connectors, and said prongs extend upwardly into said lower sleeves;

selected ones of said fence structures being L-shaped in plan configuration so as to form high strengh furniture corners;

the space between one edge of the lid and the corresponding edge of the base frame being open to form an access opening for a person desiring to move into the space circumscribed by said fence structures for safety during an earthquake.

* * * * *